US007332874B2

(12) United States Patent
Samejima et al.

(10) Patent No.: US 7,332,874 B2
(45) Date of Patent: Feb. 19, 2008

(54) DISCHARGE LAMP IGNITION DEVICE

(75) Inventors: Takanori Samejima, Himeji (JP); Masashi Okamoto, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/674,302

(22) Filed: Feb. 13, 2007

(65) Prior Publication Data

US 2007/0188109 A1 Aug. 16, 2007

(30) Foreign Application Priority Data

Feb. 13, 2006 (JP) ..... 2006-035251
Aug. 18, 2006 (JP) ..... 2006-222868

(51) Int. Cl.
*H05B 41/16* (2006.01)
*H01J 11/04* (2006.01)

(52) U.S. Cl. ..... 315/274; 315/354

(58) Field of Classification Search ..... 315/57–59, 315/64–66, 70, 72, 209 R, 224, 274, 276, 315/279, 287, 291, 307, 311; 313/594–595, 313/600–601, 243, 296, 308
See application file for complete search history.

(56) References Cited

U.S. PATENT DOCUMENTS 6,661,184 B2 * 12/2003 Okamoto et al. ..... 315/289
6,850,015 B2 * 2/2005 Ishizuka et al. ..... 315/224
7,061,188 B1 * 6/2006 Katyl et al. ..... 315/291
7,138,769 B2 * 11/2006 Suzuki et al. ..... 315/289

FOREIGN PATENT DOCUMENTS

JP 03030291 A 2/1991
JP 2003217888 A 7/2003
JP 2004327117 A 11/2004

* cited by examiner

*Primary Examiner*—Shih-Chao Chen
*Assistant Examiner*—Minh Dieu A
(74) *Attorney, Agent, or Firm*—David S. Safran

(57) ABSTRACT

To provide a discharge lamp ignition device to light high-intensity discharge lamps in which, during alternating current ignition, the fluctuation of luminous flux on the reversal of polarity of the voltage impressed on the lamp is minimized and in which steady lighting characteristics of the discharge at startup are secured, a discharge lamp ignition device has a capacitor Ch connected to a transformer Th and an intermittent voltage impression arrangement Uj to drive voltage impression on the primary winding Ph, with the secondary winding Sh of the transformer Th constituted so that the voltage generated in the secondary winding Sh can be impressed overlapping the output voltage of an inverter Ui between the electrodes of the discharge lamp Ld by interposing it in the path connecting the output of the inverter Ui and the electrode for the main discharge of the discharge lamp Ld.

5 Claims, 9 Drawing Sheets

DISCHARGE LAMP IGNITION DEVICE

BACKGROUND OF THE INVENTION

1. Field of the Invention

This invention concerns discharge lamp ignition devices for starting discharge lamps, particularly high-intensity discharge lamps, such as mercury lamps, metal halide lamps, and xenon lamps.

2. Description of Related Art

High intensity discharge lamps HID lamps are used as light sources for optical equipment used for displaying graphic images, such as liquid crystal projectors and DLP® projectors. One method used in these projectors for displaying color images is to split the three colors-red R, green G, and blue B-using a dichromic prism or other means, to generate three separate images with a space modulation element for each color, and then, to recombine the light paths using a dichromic prism or other means. Another method for displaying color images is to spin a filter that comprises a color wheel that passes the three primary colors R, G, B to sequentially generate three colored luminous fluxes by passing light from the light source through this filter, which is a dynamic color filter, and then, to sequentially generate images in the three colors by time division by means of controlling the space modulation element in synchronization with the filter.

Among the discharge lamp ignition devices that start the discharge lamps described above, there are those which, with the voltage called the no-load discharge voltage impressed on the lamp at startup, impress a high voltage to generate dielectric breakdown within the discharge space to bring about first a glow discharge, then an arc discharge, and finally the stable steady voltage. The glow discharge generally has a higher voltage than the arc discharge, and is a transitional discharge that continues until the electrode temperature is sufficient to bring about the arc discharge by means of thermionic emission. Methods of impressing a high voltage on the lamp include series triggering, in which an igniter is used overlapping the high voltage to the electrodes for the main discharge, and external triggering, in which there is an auxiliary electrode that does not contact the discharge space of the main discharge electrodes and the high voltage is impressed on the auxiliary electrode. External triggering has a number of advantages not available in series triggering. In particular, if the high voltage generation section that includes the high voltage transformer is separated from the feeder circuit and located near the discharge lamp, such useful benefits as miniaturization of the discharge lamp ignition device, lower noise, improved safety, and reduced cost can be maximized.

During steady operation, on the other hand, the methods of driving discharge lamps are the direct current drive method and the alternating current drive method. The direct current drive method has a great advantage in that the luminous flux from the lamp is of the direct current type and does not vary with time, and so it is basically possible to apply it in just the same way to both types of projectors described above. The alternating current drive method, on the other hand, has the advantage of using the freedom not found with the direct current drive method of polarity reversal frequency, and so it is possible to control the wear and service life of the discharge lamp electrodes, but there is also a disadvantage, as described below, that arises from the very existence of polarity reversal.

Normally, every reversal of polarity in an alternating current drive causes a slight variation in lamp current, such as a flicker in luminous flux from the lamp or overshoot or vibration. Consequently, if it is applied to the projectors described above that use the time division method, there is the problem that the timing with which the images are produced in succession by time division will not match the timing of the polarity reversals of the lamp's alternating current drive and fluctuation of the display image will appear at the beat frequency; depending on the frequency of the beats this can be very unsightly. It has been necessary, therefore, to devise some way to synchronize the timing of the inverter's reversal of polarity with the rotation of the color wheel, which has the drawback of complicating the discharge lamp ignition device.

In projectors using the DLP method, moreover, the brightness of each color of each pixel of the display image is controlled by the duty cycle of the individual pixel of the space modulation element. With the alternating current drive method, therefore, even if the timing is synchronized, if there is a long period of overshoot, vibration, or other fluctuation of the luminous flux when the polarity is reversed, it becomes necessary to devise either a way to not use the light during that period or a way to control the operation of each pixel of the space modulation element to suppress the fluctuation. The former course has the drawback of lowering the effective efficiency of the light beam, and the latter course has the drawback of greatly complicating the control of the space modulation element in the projector equipment.

The drawbacks related to alternating current drive of discharge lamps can be avoided by minimizing the fluctuation in luminous flux at the time of polarity reversal, but this has not been easy. That is because the discharge lamp ignition device is required not only to reduce the fluctuation of luminous flux at the time of reversal of polarity of the voltage impressed on the lamp, but also to assure steady lighting of the discharge lamp at startup.

It is known that it is effective, in order to assure steady lighting of the discharge lamp at startup, to increase the no-load discharge voltage impressed on the lamp when causing dielectric breakdown in the discharge space by means of impressing a high voltage using either series triggering or external triggering. To achieve this in the case of alternating current drive, it has been common to use what is called "resonant assist," in which dielectric breakdown in the discharge space is brought about by operating an igniter while causing a series resonance phenomenon at startup to raise the voltage impressed on the lamp.

FIG. 13 is a Figure to explain the principle of resonant assist using conventional series resonance. The discharge lamp ignition device of this Figure has a feeder circuit Ux' that feeds power to the discharge lamp Ld, a full bridge inverter Ui' made up of switching elements Q1', Q2', Q3', Q4' to invert the polarity of the output voltage of the feeder circuit Ux', and a resonant coil, Lr, a resonant capacitor Cr, and a starter circuit Ut". At startup, the inverter Ui' is driven to reverse polarity at the resonant frequency determined by the value of the product of the inductance of the resonant coil Lr and the capacitance of the resonant capacitor Cr or a frequency close to that. The LC series resonance phenomenon thus produced generates a high voltage between the terminals of the resonant capacitor Cr, and that component, together with the starter circuit Ut" connected in parallel with it, impresses a high voltage on the discharge lamp Ld.

However, with this conventional technology using LC series resonance, it is possible to solve the problem identified above of assuring steady lighting of the discharge lamp at startup, but it is not an adequate solution for the other problem of minimizing fluctuation of the luminous flux at the time of reversal of the polarity of the voltage impressed on the lamp. A brief explanation of the reasons for that is given below.

As described above, the LC resonant frequency is determined by the value of the product of the inductance of the resonant coil Lr and the capacitance of the resonant capacitor Cr, and so, if the inductance of the resonant coil Lr is kept low, the capacitance of the resonant capacitor Cr will have to be a large value. That is because, if both the inductance of the resonant coil Lr and the capacitance of the resonant capacitor Cr are small values, the resonant frequency will be quite high and it will be difficult to operate the inverter Ui'. When the capacitance of the resonant capacitor Cr has a large value, however, if one desires to obtain a sufficiently high voltage by means of resonance phenomena, one will be confronted with the problem of a very high value for the resonant current, which is the current that flows through the series connection circuit of the resonant coil Lr and the resonant capacitor Cr.

If, for example, the switching element Q1' and the switching element Q3' are in the ON state, then the resonant current will flow through the entire circuit, including the feeder circuit Ux' and the inverter Ui', as shown by the route L01 shown by the broken line in FIG. 13. For that reason, it will be necessary to use high current ratings for the circuit elements in every section in order to withstand the large resonant circuit, and increased equipment size and costs will be inevitable.

Even though the resonant frequency will be very high, one possible measure would be to reduce the value of the capacitance of the resonant capacitor Cr in order to hold down the operating frequency of the inverter Ui', if operating at a high order of resonance. Even in that case, however, the resonant current would flow along the route L01 shown by the broken line in FIG. 13, as described above, and the resistance of the switching element in the ON state at the time would be relatively large, and so the Q value of the resonant circuit would be small. Therefore, there would be severe attenuation of the resonance and use of high-order resonance would be impossible.

Accordingly, as long as LC series resonance is used, it will be impossible to reduce the inductance of the resonant coil Lr; a large value will inevitably be required. However, at the stage when the lamp startup is completed, regular operation begins, and the lamp's light is in use, a large inductance value for the resonant coil Lr will be a considerable impediment. Generally speaking, in cases where the resonant coil Lr or a large inductance such as an igniter is inserted at a stage subsequent to the inverter, inconvenient phenomena, such as luminous flux overshoot or vibration at the time of reversal of polarity will be encouraged, with the result that it has become necessary to solve the problem of reducing fluctuation of luminous flux at the time of reversal of polarity of the voltage impressed on the lamp.

In the case of external triggering, on the other hand, there is no need for an igniter with high inductance as in the case of series triggering, and so, if the circuit is designed with care not to insert anything like a resonance coil Lr, it will be well suited to avoiding inconvenient phenomena, such as luminous flux overshoot or vibration at the time of reversal of polarity. In the case of external triggering, as existing technology for realization of increased no-load discharge voltage to impress on the lamp when dielectric breakdown in the discharge space is brought about as described above, Japanese pre-grant patent publication 2003-092198 (U.S. Pat. No. 6,661,184 B2) describes a method of impressing high voltage on the pair of electrodes for main discharge by at least partially overlapping the period when an external triggering starter is generating high voltage, which can realize the anticipated function.

In that technology, however, the no-load discharge voltage increases along with the production of high voltage by the starter, and so, after dielectric breakdown succeeds and the starter ceases operation, there is also an end to the increase of no-load discharge voltage impressed on the lamp when the dielectric breakdown was brought about in the discharge space. In order to maintain a glow discharge, therefore, it is necessary that the feeder circuit directly generate a no-load discharge voltage of higher voltage than the glow discharge voltage. That being the case, since the inverter is located at a stage subsequent to the feeder circuit, it is necessary to build the circuitry with elements that can withstand the high-voltage no-load discharge voltage.

However, in addition to the cost of the FET or other switching elements that make up the inverter increasing with their voltage resistance, loss is greater and heat-radiation countermeasures are more costly. These factors increase the cost of the discharge lamp ignition device as a whole and make miniaturization impossible.

Other related devices are described in Japanese Pre-Grant Patent Publication Nos. H03-030291, 2003-217888 and 2004-327117.

SUMMARY OF THE INVENTION

Thus, an object of the present invention is to provide a discharge lamp ignition device that minimizes fluctuation of luminous flux at the time of reversal of polarity of the voltage impressed on the lamp during alternating current operation of the discharge lamp, and at the same time, secures steady lighting of the discharge lamp at startup.

This object is achieved by a discharge lamp in accordance with invention in which a discharge lamp ignition device used to light a discharge lamp is provided with a pair of facing electrodes as the main electrodes, a feeder circuit that feeds power to the discharge lamp, an inverter located at a stage following the feeder circuit that inverts the polarity of the voltage impressed on the discharge lamp, a transformer with a primary winding and a secondary winding, a capacitor connected to the transformer, and an intermittent voltage impression means to drive impression of voltage on the primary winding, in which the secondary winding of the transformer is constituted such that the voltage generated in the secondary winding can be impressed overlapping the output voltage of an inverter between the electrodes of the discharge lamp by means of interposing it in the route connecting the output of the inverter and the electrode for the main discharge of the discharge lamp, the capacitance of the capacitor being set such that the free oscillation frequency of the voltage generated in the secondary winding does not exceed 3 MHz, and in which, during startup of the discharge lamp, the intermittent voltage impression means drives voltage impression at an average frequency of at least 8,000 repetitions per second and the voltage impression drive continues for a period even after discharge begins in the discharge lamp.

In accordance with another feature of this invention the discharge lamp ignition device described above is constituted such that the total inductance of components along the main discharge current route of the discharge lamp in the stages subsequent to the inverter does not exceed 160 μH.

In accordance with another feature of this invention, the intermittent voltage impression means of the discharge lamp ignition device described above comprises a voltage impression drive power supply and a voltage impression drive switching element and impresses a voltage on the primary winding when the voltage impression drive switching element is in the ON state.

In accordance with another feature of this invention, the voltage that is output for the feeder circuit to impress as the no-load discharge voltage is set lower than the glow discharge voltage generated in the discharge lamp.

EFFECT OF THIS INVENTION

The discharge lamp ignition device of this invention is able to minimize fluctuation of luminous flux at the time of reversal of polarity of the voltage impressed on the lamp during alternating current operation of the discharge lamp, and at the same time secure steady lighting of the discharge lamp at startup.

DETAILED DESCRIPTION OF THE INVENTION

Figure 1:
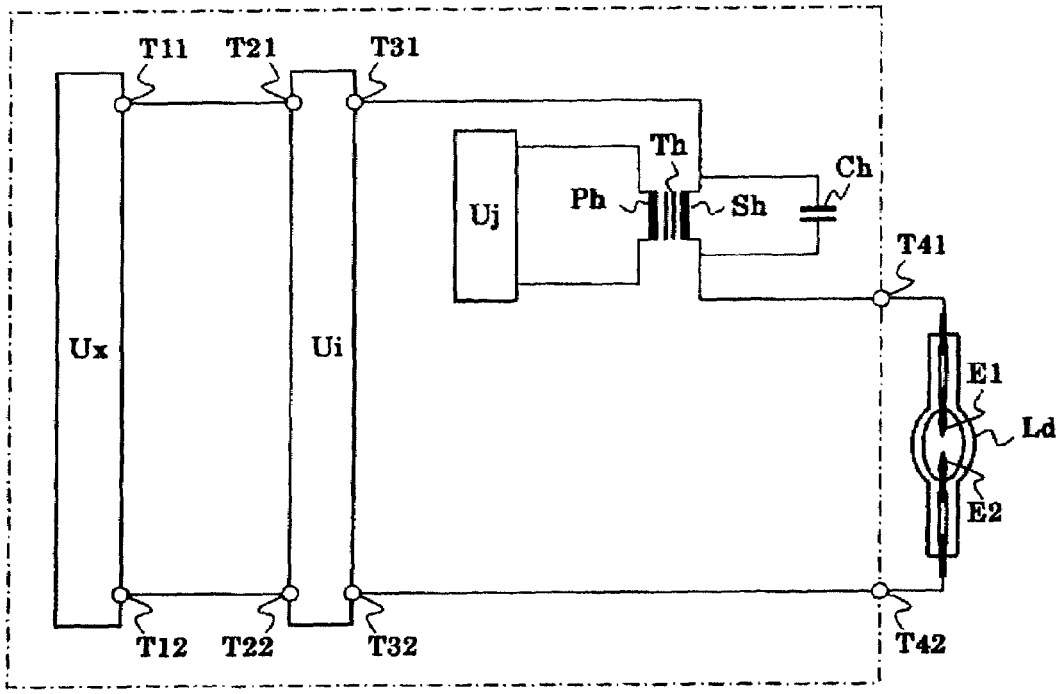
FIG. 1 is a block diagram showing the discharge lamp ignition device of this invention in simplified form.

First, an embodiment of this invention is explained with reference to FIG. 1, which is a block diagram showing the discharge lamp ignition device of this invention in simplified form. A feeder circuit Ux comprising a step-up chopper, step-down chopper, or other switching circuitry outputs a suitable voltage and current in accordance with the state of the discharge lamp Ld or the lighting sequence. An inverter Ui comprising a full-bridge circuit converts the output voltage of the feeder circuit Ux to an alternating current voltage that is periodically reversed and outputs it, and the voltage is impressed on the pair of main discharge electrodes of the discharge lamp Ld after passing through the secondary winding Sh of a transformer Th.

Now, at startup of the lamp, the no-load discharge voltage output by the feeder circuit Ux is typically about 200 V to 300 V, the lamp voltage is typically about 100 V to 220 V during glow discharge, and the lamp voltage immediately after the transition to arc discharge is about 10 V. The feeder circuit Ux is controlled so that the current flowing during glow discharge and during arc discharge does not exceed specified limit current values.

An intermittent voltage impression means Uj is connected to the primary winding Ph of the transformer Th such that it can intermittently drive the impression of voltage on the primary winding Ph. However, the inductance of the secondary winding Sh of the transformer Th should not be excessive, so there will not be inconvenient phenomena, such as overshoot or vibration of the luminous flux during polarity reversal. A capacitor Ch is connected in parallel to the secondary winding Sh of the transformer Th; the capacitance of the capacitor Ch is such that the free oscillation frequency of the voltage produced in the secondary winding Sh does not exceed 3 MHz. Having a relatively high value like this as the maximum value of the free oscillation frequency of voltage in the secondary winding Sh is greatly preferred in order to keep the inductance of the secondary winding Sh low.

This free oscillation frequency is the frequency of voltage oscillation produced in the secondary winding Sh in the intervals in voltage impression drive by the intermittent voltage impression means Uj when a discharge is not generated in the discharge lamp Ld or when the discharge lamp ignition device is not connected to the discharge lamp Ld; normally, it is calculated with consideration to the resonant frequency of the LC resonant circuit primarily made up of the capacitance of the capacitor Ch and the inductance of the secondary winding Sh, and is the product of that capacitance and inductance. However, in the event that the secondary winding Sh includes some kind of capacitance component, such as floating capacitance, a correction must be made to the results of the calculation of the oscillation frequency.

At startup, the feeder circuit Ux outputs a voltage to be impressed on the discharge lamp Ld as the no-load discharge voltage, and the intermittent voltage impression means Uj drives voltage impression on the primary winding Ph at an average frequency of at least 8,000 repetitions per second. Now, the reason that this is specified as an average frequency rather than a cyclical frequency is that the voltage impression drive need not be cyclical, but can be an intermittent drive with disrupted periodicity. Within the transformer Th, the voltage impressed on or produced in the primary winding Ph is induced in the secondary winding Sh, the voltage being transformed by the winding ratio. During the period of voltage impression drive excitation energy is stored in the transformer Th, and when the voltage impression drive is completed, the stored excitation energy is released by the fly-back effect of the transformer Th, and so a high voltage is produced in the secondary winding Sh. This voltage is gradually attenuated during oscillation at the free oscillation frequency.

By repetition of voltage impression drive by the intermittent voltage impression means Uj, there is a quasi-continuous state of oscillating high voltage output from the secondary winding Sh overlapped on the voltage output from the feeder circuit Ux on the electrodes E1, E2 for the main discharge of the discharge lamp Ld. Thus, by operating at an appropriate frequency, in parallel with that, an external triggering starter, such as that described hereafter relative to FIG. 7 (not illustrated in FIG. 1), it is possible to bring about dielectric breakdown in the discharge space of the discharge lamp Ld and start the main discharge of the lamp. The 3 MHz maximum value of the free oscillation frequency for voltage excitation in the secondary winding Sh is a limiting value of which the sinusoidal free oscillation voltage waveform half-wave width is too small and unable to effectively start the main discharge of the lamp; it was determined through experimentation.

When the main discharge begins, a glow discharge will be produced if there is no mercury or other condensate or coagulate adhered to the cathode-side electrode of the electrodes E1, E2 of the discharge lamp Ld. In the event that such a condensate or coagulate is adhered, an arc-discharge-like discharge known as "field emission" is produced; when this discharge has dried the electrode by vaporizing the condensate or coagulate, there is a transition to glow discharge. Then, when there an electrode temperature sufficient to generate an arc discharge by thermionic emission is reached, there is a transition from glow discharge to arc discharge.

For a suitable transition to ark discharge, it is necessary to inject an appropriate amount of energy into the lamp during the glow discharge period. In the event that the energy injection is inadequate, there is a possibility that the main discharge will die out, at which time it would be necessary to retry dielectric breakdown by the starter; repetition of that is liable to damage the lamp. On the other hand, if too much energy is injected, that is of course liable to damage the lamp, but in either case the damage will be manifest as blackening of the lamp bulb. That is because, first of all, "glow discharge" accompanies the phenomenon of anions colliding with the cathode after acceleration by the electric field at a relatively high voltage; because the anions are relatively heavy, their collision with the electrode causes spatter, the phenomenon of flying bits of tungsten or other electrode material, and the spattered electrode material adheres to the inner surface of the lamp bulb.

Energy, by the way, is defined as the product of power and time, but damage in the case of excessive energy injection is caused only if the power is too great. That is because of an automatic control function: as long as the injected power is of a suitable amount, the injected energy increases monotonously with the passage of time, and as it does, the electrode temperature rises, glow discharge ends, and there is a transition to low-voltage arc discharge. Because of that, the lamp itself automatically cuts off the energy injection of glow discharge, and excessive energy injection is avoided, so that the lamp bulb is not darkened to a harmful degree. In the event of an excessive injection of power, on the other hand, it is conjectured that large numbers of anions instantly collide with the electrode before the completion of transition to arc discharge, without waiting for the automatic control function to operate, and a large amount of spattering electrode material adheres to the inner surface of the lamp bulb causing severe darkening of the lamp bulb.

Cyclical or intermittent voltage impression by the intermittent voltage impression means Uj is most suitable for effectively injecting energy into a lamp in this glow-arc status. That is, because cyclical or intermittent voltage impression by the intermittent voltage impression means Uj provides what is called pulsed injection of energy; rather than injecting energy throughout the glow-discharge transition period, the number of energy pulses is increased one-by-one until the amount of energy needed to enable transition to an arc discharge is obtained, and the transition to arc discharge is accomplished as an inevitable phenomenon. However, a lamp in glow-discharge status differs from a lamp in unlighted status in having a low impedance, and so the voltage waveform of the secondary winding Sh during the injection of energy pulses is not a sinusoidal free oscillation, but this is no problem.

However, the electrode temperature rise that occurs between injection of one energy pulse and injection of the next energy pulse is suppressed if that the frequency of the voltage impression drive by the intermittent voltage impression means Uj is too low, and an electrode temperature sufficient to produce arc discharge by means of thermionic emission will not be achieved. For that reason, there is a lower limit to the frequency of the voltage impression drive. It has been determined experimentally that the limiting value in this situation is 8,000 repetitions per second as the lower limit for the average frequency of voltage impression drive by the intermittent voltage impression means Uj.

Thus, in accordance with this invention, it is possible to hold the inductance of the secondary winding Sh to a low value, and so when bringing about dielectric breakdown in the discharge space of the lamp, it is possible to heighten the no-load discharge voltage impressed on the lamp and to effectively inject energy into the lamp when in a state of glow discharge, without causing inconvenient phenomena, such as overshoot or vibration of the luminous flux during polarity reversal. Because of that, even during alternating current lighting of a discharge lamp, it is possible to minimize fluctuation of the luminous flux during reversal of the polarity of the voltage impressed on the lamp, and at the same time, to assure steady lighting of the discharge lamp at startup.

Now, as described above, the free oscillation frequency is decided on the basis of the inductance of the secondary winding Sh and the capacitance of the capacitor Ch and the smaller the capacitance of the capacitor Ch is, the higher the voltage produced in the secondary winding Sh will be, but floating capacitance in the secondary winding Sh or some subsequent stage, such as the cable that connects to the discharge lamp Ld will cause scattering or fluctuation of the voltage produced, and the smaller the capacitance of the capacitor Ch, the greater the scattering or fluctuation will be. And so, it is necessary to set the capacitance of the capacitor Ch at a value that is not too low, so that the effect of the floating capacitance can be ignored.

In accordance with this invention, the frequency of the voltage impression drive of the intermittent voltage impression means Uj can be either the basic frequency of the free oscillation frequency, or in a high-order resonant relationship with it, but constitution with a resonant relationship is good, and has the advantage of enabling effective voltage boosting.

To investigate the upper limit of inductance in the secondary winding Sh that could be used without practical problems when the discharge lamp ignition device was used as the light source for a projector of the DLP type, 0.15 to 0.3 mg of mercury per cubic millimeter of discharge space was placed along with bromine and argon gas in bulbs made of quartz glass, to make various high-pressure mercury lamps having tungsten electrodes of 0.9 to 1.2 mm, rated power of 120 to 300 W, and steady-burning lamp voltages from 65 to 85 V. These lamps and discharge lamp ignition devices with coils of various inductances inserted at a stage subsequent to the inverter were mounted in actual projectors, and display quality was observed and evaluated under operating conditions in which the timing of polarity reversal by the inverter was not synchronized with rotation of the color filter. It was confirmed that there were no practical problems if the inserted inductance did not exceed 73 μH. Further, it was confirmed that, if the timing of polarity reversal by the inverter was synchronized with rotation of the color filter, there were no practical problems if the inserted inductance was increased but did not exceed 160 μH.

However, in the case of application of projectors of the DLP type in televisions of the rear-projection type, in an experiment with high-pressure mercury lamps of which the rated power did not exceed 200 W, there are severe demands for half-tone pixel quality, and so it is preferable either to synchronize the timing of polarity reversal by the inverter with rotation of the color filter or to hold the inserted inductance to no more than 55 μH. In such applications, it was found preferable to hold the inserted inductance to no more than 120 μH even if the timing of polarity reversal by the inverter was synchronized with rotation of the color filter.

Figure 2:
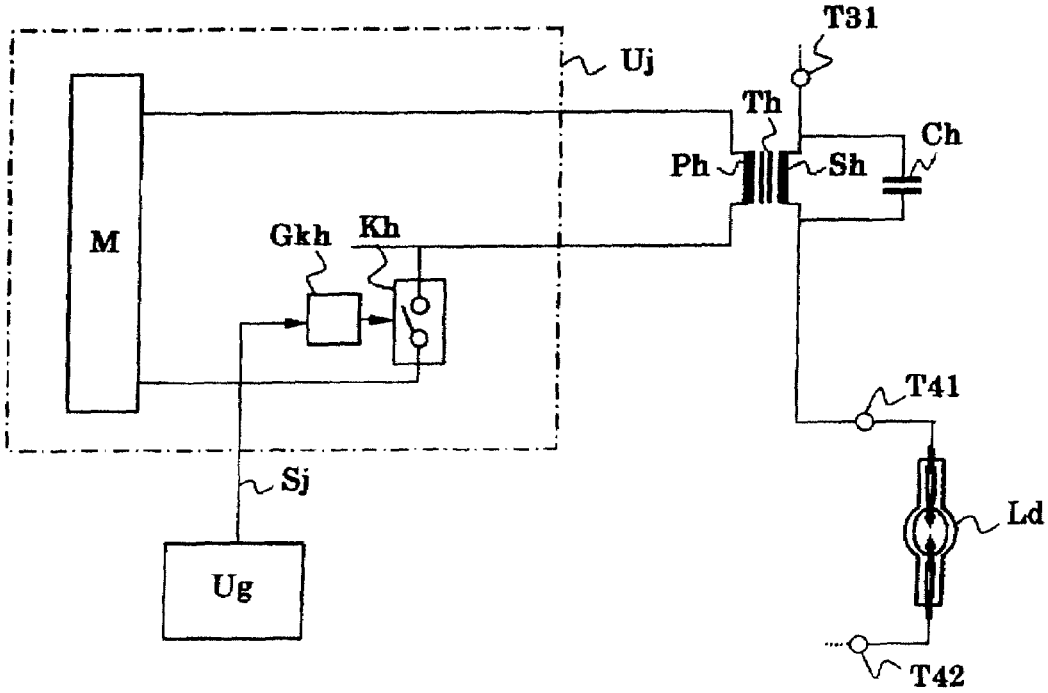
FIG. 2 is a block diagram showing a portion of an embodiment of the discharge lamp ignition device of this invention in simplified form.

Another embodiment of this invention is explained here with reference to FIG. 2. This drawing shows an example of the constitution of the intermittent voltage impression means Uj described relative FIG. 1. The intermittent voltage impression means Uj comprises a voltage impression drive power supply Mh and a MOSFET or other voltage impression drive switching element Kh connected in series. When the voltage impression drive switching element Kh is in the ON state, voltage impression drive of the primary winding Ph is possible. Control of the voltage impression drive switching element Kh is accomplished on the basis of an intermittent drive control signal Sj from an intermittent drive control circuit Ug passing through gate drive circuitry Gkh.

If there is a chance that, in the instant that the voltage impression drive switch Kh is turned to the ON state, the current that is to charge the capacitor Ch connected to the secondary winding Sh could cause damage by surging into the voltage impression drive switch Kh, a resistance, coil, or other current-limiting element can be inserted in series with the voltage impression drive switch Kh. The intermittent drive control circuit Ug can be constituted as a simple multivibrator that oscillates and a desired frequency which is the average frequency of voltage impression drive by the intermittent voltage impression means Uj. Thus, in the startup sequence of the discharge lamp, after completion of the lamp's transition to arc discharge, a startup control signal Sz output by a feeder control circuit Fx (to be described hereafter) is received so that the intermittent drive control circuit Ug can stop generation of the intermittent drive control signal Sj.

In accordance with this invention, as described above, energy injection into a lamp in glow discharge status can be performed effectively by the intermittent voltage impression means Uj, but that requires that the voltage produced by the intermittent voltage impression means Uj exceed the glow discharge voltage of the lamp. As stated above, the inductance of the lamp is low during the period of glow discharge, and so a high voltage in the secondary winding Sh is not produced by the fly-back effect in the transformer Th.

However, if the relationship between the voltage of the voltage impression drive power supply Mh and the winding ratio of the transformer Th is set so that the voltage induced in the secondary winding Sh is higher than the glow discharge voltage during what is called forward action, when voltage impression on the primary winding Ph is driven by the intermittent voltage impression means Uj, then the injection of energy into the lamp in glow discharge status can be performed effectively even if the voltage output by the feeder circuit Ux is lower than the voltage of the glow discharge in order to impress a no-load discharge voltage on the lamp.

Figure 3:
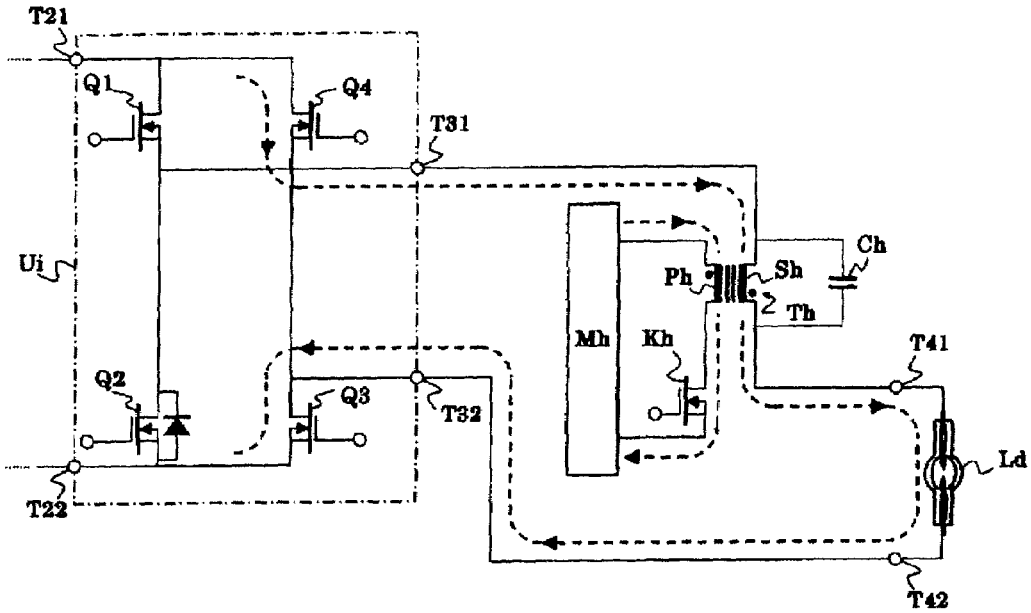
FIG. 3 is a diagram showing the constitution of a portion of an embodiment of the discharge lamp ignition device of this invention in simplified form.

As shown in FIG. 3, with the switching elements Q1, Q3 of the inverter Ui in the ON state and the switching elements Q2, Q4 in the OFF state, if the primary and secondary winding directions of the transformer Th are set so that the voltage generated in the secondary winding Sh overlaps and is added to the output voltage of the inverter Ui when the voltage impression drive switching element Kh is driven, then it is possible to feed power to the discharge lamp Ld in glow discharge status by means of current flowing in the direction shown by the broken line arrows in the figure. Using that function of this invention, the voltage that the feeder circuit Ux outputs for impression of no-load discharge voltage on the lamp is reduced, and so it is possible to hold the maximum output voltage of the feeder circuit Ux to just the level of the arc discharge voltage during steady burning.

In this way, because the voltage that is input to and output from the inverter Ui located at a stage subsequent to the feeder circuit Ux is kept low, only low voltage resistance is needed for the switching elements Q1, Q2, Q3, Q4. Switching elements Q1, Q2, Q3, Q4 that can withstand low voltages are less costly, have less ON resistance, and have lower loses during steady burning than those which can withstand high voltages, and so it is possible to simplify heat radiation measures, to increase overall efficiency, to reduce size and weight, and to achieve lower costs.

Figure 4:
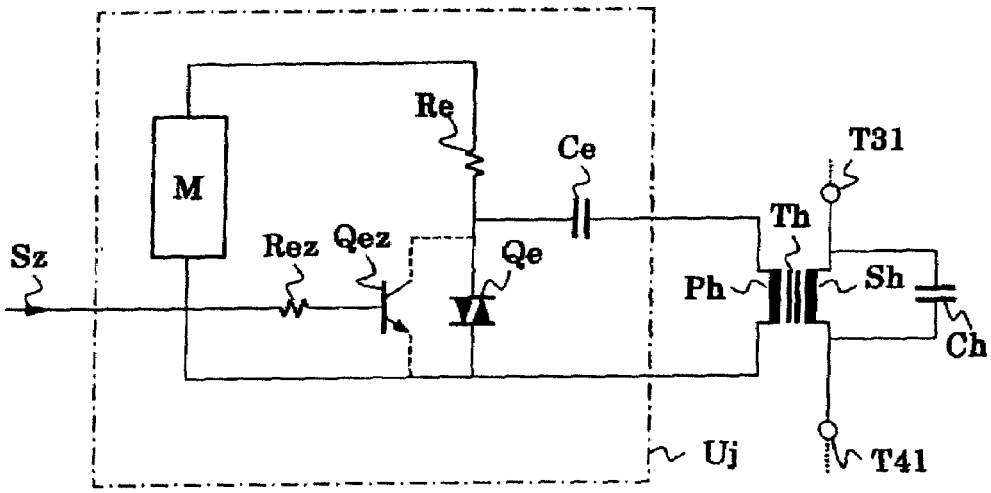
FIG. 4 is a block diagram showing a portion of an embodiment of the discharge lamp ignition device of this invention in simplified form.

Another embodiment of this invention is explained here with reference to FIG. 4. This drawing shows another example of the constitution of the intermittent voltage impression means Uj described in FIG. 2. The voltage impression drive switching element is a voltage-sensitive switching element Qe, which is an element that is maintained in the OFF state until the impression voltage reaches the designated threshold voltage; when the threshold voltage is passed, it turns to the ON state and current begins to flow, and it maintains the ON state as long as current actually continues to flow. A sidac, for example, can be used.

A capacitor Ce is charged by the voltage impression drive power supply Mh, through a resistance Re and the primary coil Ph. When the voltage of the capacitor Ce has reached the voltage to operate the voltage-sensitive switching element Qe, the voltage-sensitive switching element Qe is changed to the ON state and voltage impression on the primary winding Ph is driven. The drive cycle of the intermittent voltage impression means Uj is stipulated on the basis of a time constant from the capacitor Ce and the threshold voltage of the voltage-sensitive switching element Qe.

Now, the voltage impression drive power supply Mh can be combined with the feeder circuit Ux, in which case the voltage of the voltage impression drive power supply Mh will vary in response to the state of the discharge lamp Ld. Therefore, as described above, the voltage-sensitive switching element Qe will continue to operate with the lamp in the status prior to commencement of discharge and in the glow discharge status; operation of the voltage-sensitive switching element Qe ceases after transition to arc discharge status.

Another possibility is shown within the broken line in this figure by which there can be a transistor or other switching element Qez that receives a startup control signal Sz output from the feeder control circuit Fx through a resistance Rez; the signal turns on the switching element Qez, forcing cessation of the action of the voltage-sensitive switching element Qe and thus controlling the action of the intermittent voltage impression means Uj.

Figure 5:
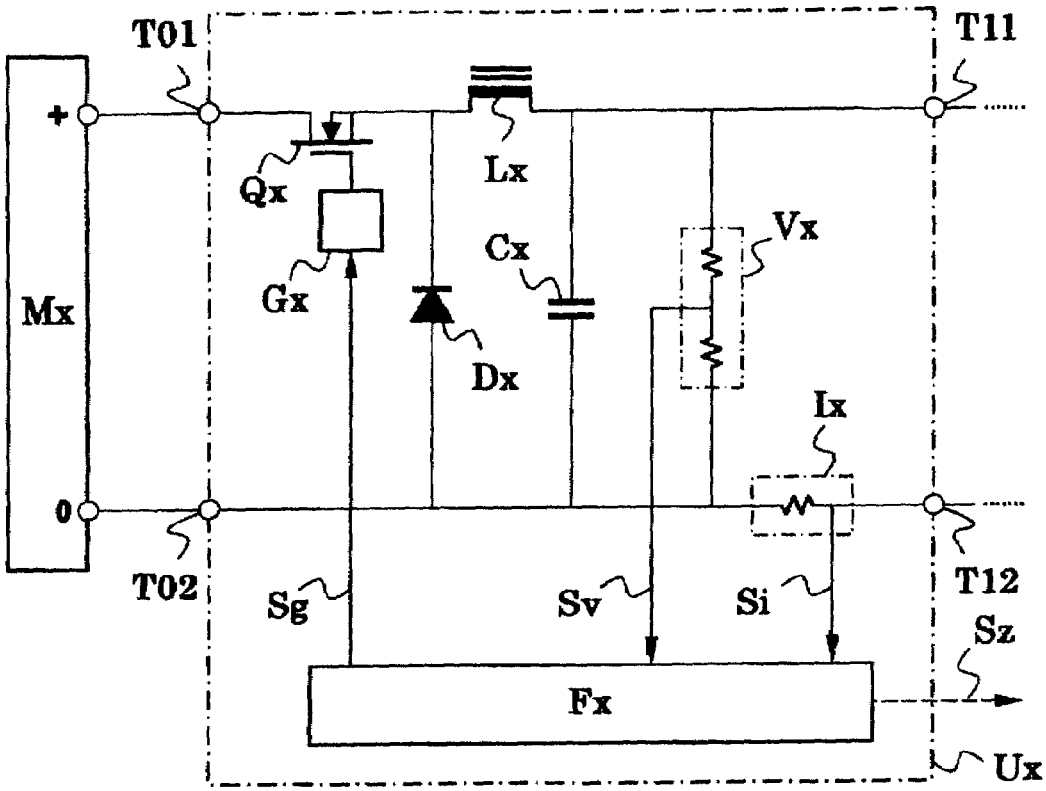
FIG. 5 is diagram showing the constitution of a portion of an embodiment of the discharge lamp ignition device of this invention in simplified form.

Next, an embodiment of this invention is explained with reference to a working diagram that shows the structure more specifically. FIG. 5 shows a concrete example of a feeder circuit Ux that can be used in the discharge lamp ignition device of this invention. The feeder circuit Ux, which is based on a step-down chopper circuit, operates on receipt of a voltage supply from a PFC or other DC power supply Mx and regulates the amount of power supplied to the discharge lamp Ld. Within the feeder circuit Ux, an FET or other switching element Qx turns the current from the DC power supply on and off and charges a smoothing capacitor Cx through a choke coil Lx. The voltage is impressed on the discharge lamp Ld, making it possible for current to flow to the discharge lamp Ld.

Now, while this switching element Qx is in the ON state, the current that passes through the switching element Qx directly charges the smoothing capacitor Cx and feeds current to the discharge lamp Ld which is its load, as well as storing energy in the form of magnetic flux in the choke coil Lx. While the switching element Qx is in the OFF state, the energy stored in the form of magnetic flux in the choke coil Lx charges the smoothing capacitor Cx through a flywheel diode Dx and feeds current to the discharge lamp Ld.

In a feeder circuit Ux of the step-down chopper type, the amount of power fed to the discharge lamp Ld can be regulated by means of the duty cycle, which is the ratio of the period that the switching element Qx is in the ON state to operational cycle of the switching element Qx. In this case, a gate drive signal Sg that has the duty cycle is generated by a feed control circuit Fx; it controls the gate terminal of the switching element Qx through a gate drive circuit Gx, and so controls the ON and OFF states of current from the DC power supply Mx.

The lamp current flowing between the electrodes E1, E2 of the discharge lamp Ld and the lamp voltage produced between the electrodes E1, E2 can be detected by the lamp current detection means Ix and the lamp voltage detection means Vx. Now, these can be realized simply, by using a shunt resistance for the lamp current detection means Ix and using a voltage-dividing resistance for the lamp voltage detection means Vx.

The lamp current detection signal Si from the lamp current detection means Ix and the lamp voltage detection signal Sv from the lamp voltage detection means Vx are input to the feeder control circuit Fx. During the period at lamp startup, when lamp current is not flowing, the feeder control circuit produces a gate drive signal as feedback so that the specified voltage will be output in order to impress the no-load discharge voltage on the lamp. When the lamp starts up and a discharge current is flowing, a gate drive signal is produced as feedback so that the target lamp current can be output. In this case, the target lamp current depends on the voltage of the discharge lamp Ld, and is basically a value such that the power injected into the discharge lamp Ld will be the designated level of power. However, if the discharge lamp Ld voltage is low immediately after startup, it will not be possible to supply the rated power, and so the target lamp current is controlled so as to not exceed a given control value called the "initial control current." The discharge lamp Ld voltage rises as the temperature rises, and if the current required for injection of the specified power does not exceed the initial control current, there is a smooth transition to a state in which injection of the specified power will be possible.

Figure 6:
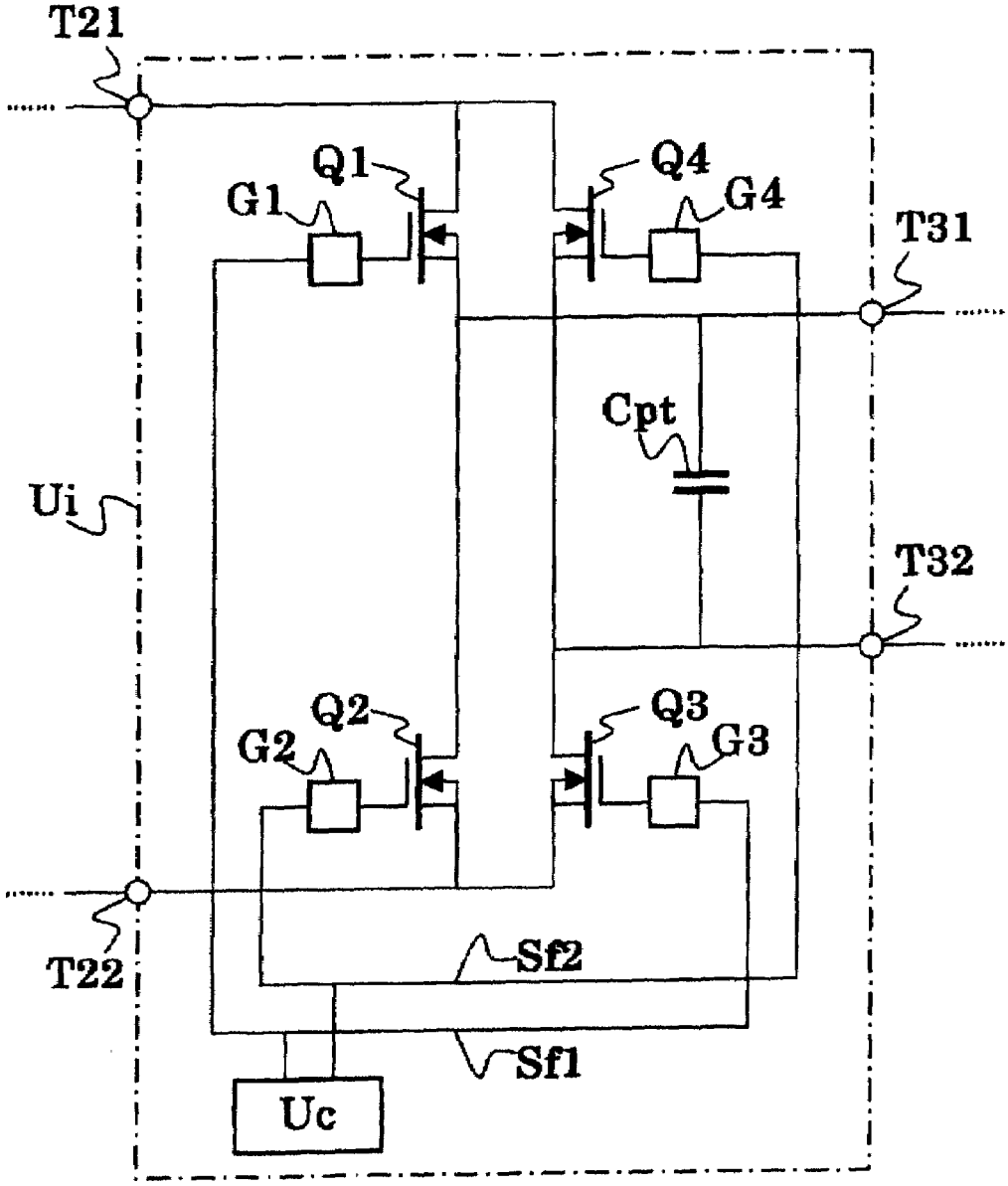
FIG. 6 is diagram showing the constitution of a portion of an embodiment of the discharge lamp ignition device of this invention in simplified form.

FIG. 6 shows, in simplified form, an example of an inverter Ui that can be used in the discharge lamp ignition device of this invention. The inverter Ui comprises a full-bridge circuit using FETs or other switching elements Q1, Q2, Q3, Q4. The switching elements Q1, Q2, Q3, Q4 are driven by their respective gate control circuits G1, G2, G3, G4, and the gate control circuits G1, G2, G3, G4 are controlled by inverter control signals Sf1, Sf2 from the inverter control circuit Uc such that in the phase where the diagonally opposed pair of switching element Q1 and switching element Q3 are in the ON state, the other diagonally opposed pair of switching element Q2 and switching element Q4 are in the OFF state, and in the phase where the diagonally opposed pair of switching element Q2 and switching element Q4 are in the ON state, the other diagonally opposed pair of switching element Q1 and switching element Q3 are in the OFF state. When there is a switch between these two phases, a period called "dead time," during which all of the switching elements Q1, Q2, Q3, Q4 are in the OFF state, is inserted.

Now, in the event that the switching elements Q1, Q2, Q3, Q4 are MOSFETs, for example, a parasitic diode in the direction from the source terminal to the drain terminal is incorporated in the element itself not illustrated, but with elements like bipolar transistors where there is no parasitic diode, it is preferable that a diode corresponding to a parasitic diode be connected in a reverse parallel connection. That is because of the risk of damage to the element from the occurrence of reverse voltage, since at the time of a phase switch or during dead time, there will be a flow of induced current arising from the inductance component that exists in a stage subsequent to the inverter Ui.

Figure 7:
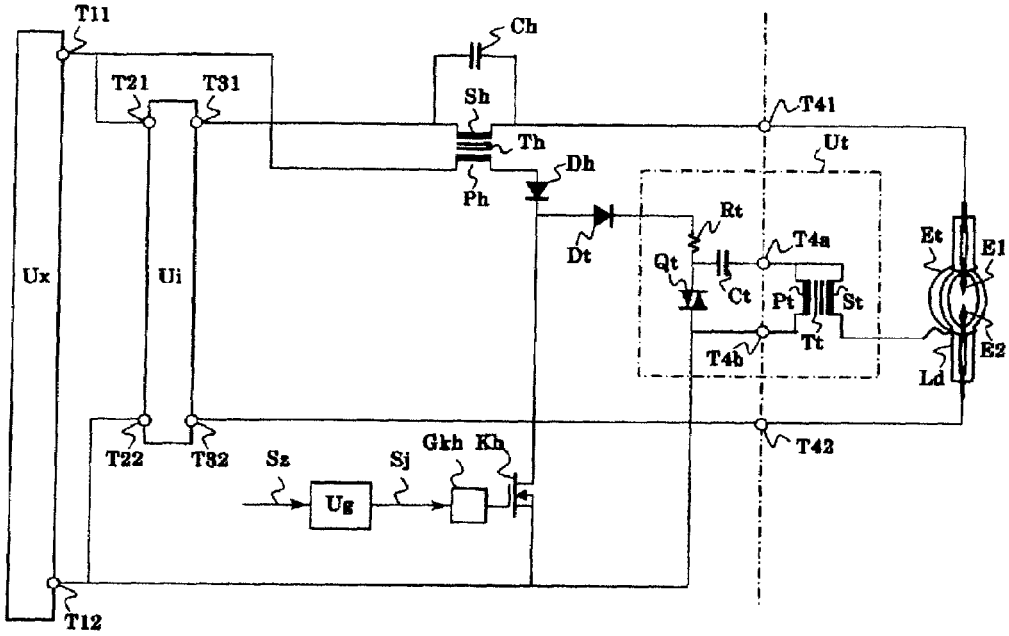
FIG. 7 is diagram showing the constitution of an embodiment of the discharge lamp ignition device of this invention in simplified form.

FIG. 7 is a diagram that shows, in simplified form, an embodiment of the discharge lamp ignition device of this invention. The voltage impression drive power supply Mh of the intermittent voltage impression means Uj is combined with feeder circuit Ux, and is connected to the primary winding Ph of the transformer Th. The MOSFET or other voltage impression drive switching element Kh is controlled by the intermittent drive control circuit Ug through the gate drive circuit Gkh and moves back and forth between the ON and OFF states cyclically or intermittently, driving voltage impression on the primary winding Ph through a diode Dh.

Through this action of the intermittent voltage impression means Uj, an alternating current high voltage that oscillates quasi-continually at the desired free oscillation frequency is produced in the secondary winding Sh of the transformer Th. This high voltage overlaps the no-load discharge voltage from the feeder circuit Ux that appears on the output nodes T31, T32 of the inverter Ui, and is impressed on the main discharge electrodes E1, E2 of the discharge lamp Ld, which are connected to the nodes T41, T42. Now, while the voltage impression drive switch Kh is in the OFF state, an oscillating voltage appears on the primary winding Ph and that overlaps the electrical potential on the node T11, so that the potential on the cathode of the diode Dh for the node T12 is higher than the potential of the node T11. By making use of that phenomenon, it is possible to effectively feed power to the starter circuit Ut even in the event that the output of the feeder circuit Ux is kept low.

In a discharge lamp Ld of the external triggering type, an auxiliary electrode Et other than the electrodes E1, E2 for main discharge is located such that it does not contact the discharge space. The circuit constitution is such that high voltage pulses generated in the secondary winding St of the starter transformer Tt of the starter circuit Ut are impressed on the auxiliary electrode Et. Within the starter circuit Ut, a capacitor Ct is charged relatively slowly, receiving the potential of the cathode of the diode Dh through the diode Dt and through a resistance Rt and the primary winding Pt of the transformer Tt. When the charging voltage of the capacitor Ct reaches a specified level, a switching element Qt that comprises a sidac or other voltage-sensitive element transitions to the ON state and the voltage of the capacitor Ct is impressed as a pulse on the primary winding Pt so that a high-voltage pulse is generated in the secondary winding St of the transformer Tt. It is also possible to use, as the switching element Qt, one which has a triggering terminal, such as an SCR.

As stated above, in the state where an alternating current high voltage from the transformer Th is impressed on the main discharge electrodes E1, E2 of the discharge lamp Ld, it is possible to start the main discharge of the discharge lamp Ld with very high reliability by impressing high voltage pulses from the starter transformer Tt on the auxiliary electrode Et of the discharge lamp Ld. Now, the discharge lamp ignition device of this figure is best constituted with the portion to the right of the nodes T41, T4*a*, T4*b*, T42 unified with the discharge lamp Ld.

Figure 8:
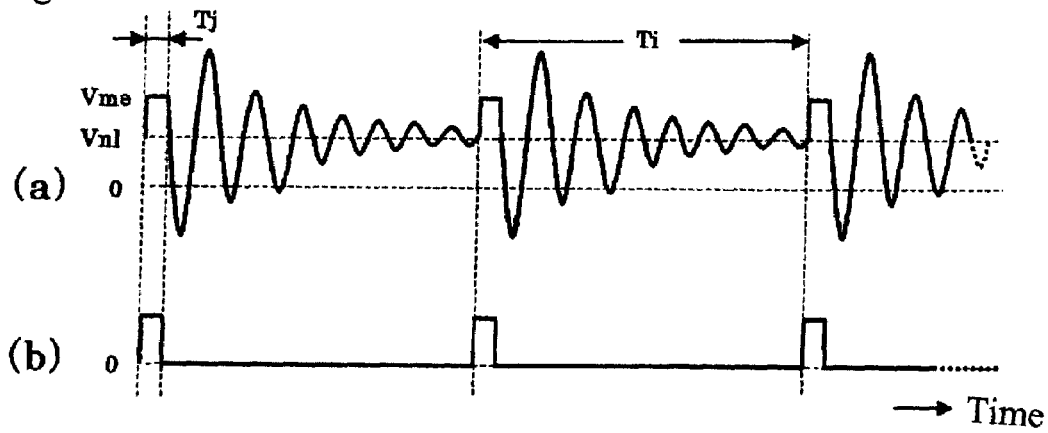
FIG. 8 is a simplified waveform diagram of an embodiment of the discharge lamp ignition device of this invention.

FIG. 8 is a concept drawing of one example of the waveform of an embodiment of the discharge lamp ignition device of this invention. This drawing illustrates the operation of the discharge lamp ignition device described in FIG. 7, with plot (a) representing the waveform of voltage impressed on the electrodes E1, E2 of the discharge lamp Ld, and plot (b) representing the state of the intermittent drive control signal Sj, which is activated only in the period Tj of the cycle Ti of the intermittent drive control signal Sj. During the period Tj, voltage impression on the primary winding Ph of the transformer Th is driven, but because there is no discharge in the discharge lamp Ld and thus no load, excitation energy is stored. At that time, the voltage impressed on the discharge lamp Ld is the voltage Vme, which is the voltage Vnl output from the feeder circuit Ux to be impressed on the lamp as the no-load discharge voltage, overlapped with the voltage of the secondary winding Sh that is produced in accordance with the winding ratio of the transformer Th. When the intermittent drive signal Sj is deactivated, the excitation energy stored in the transformer Th is released, and a gradually attenuating high voltage that oscillates at the free oscillation frequency is produced on the secondary winding Sh.

Figure 9:
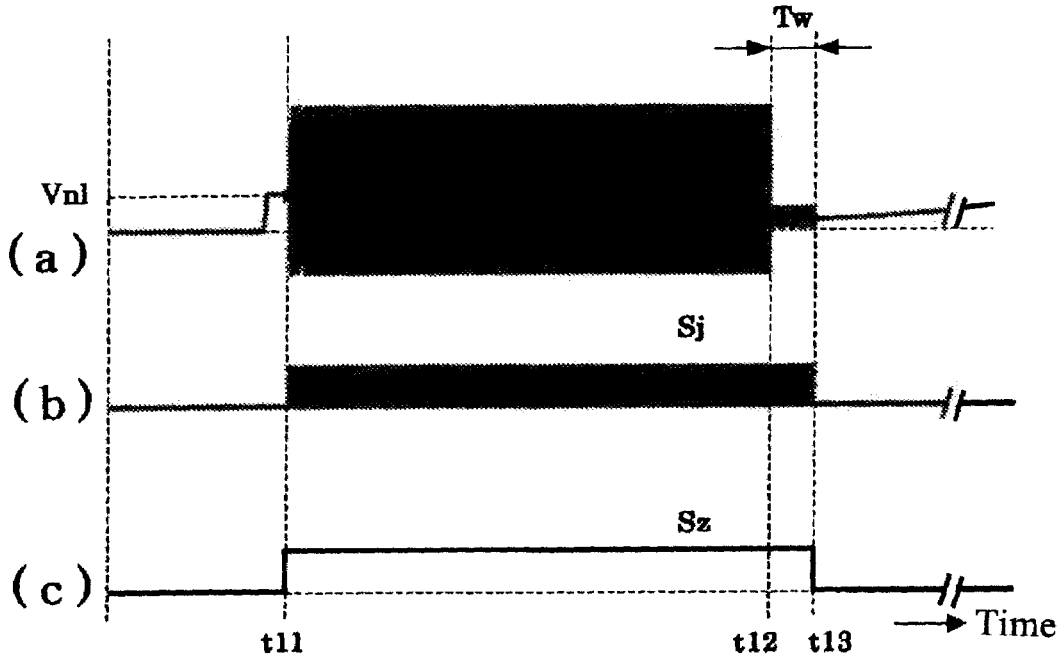
FIG. 9 is a simplified timing chart of an embodiment of the discharge lamp ignition device of this invention.

FIG. 9 is an example of a timing chart showing conceptually the operation of the discharge lamp ignition device of this invention. In it, plot (a) represents the waveform of the voltage impressed on the electrodes E1, E2 of the discharge lamp Ld, plot (b) represents the state of the intermittent drive control signal Sj, and plot (c) represents the state of the startup control signal Sz. In the lamp's startup sequence, after the feeder circuit Ux outputs a voltage for impression of the no-load discharge voltage, the startup control signal Sz is activated at the point in time t11; this starts production of the intermittent control signal Sj, and the state in which is the voltage output from the feeder circuit Ux overlapped with the oscillating high voltage output from the secondary winding Sh is impressed on the discharge lamp Ld is realized on a quasi-continuous basis.

At the point in time t12, the commencement of discharge in the discharge lamp Ld is detected and, after a specified period of time Tw, the startup control Sz is deactivated and the intermittent drive control signal Sj for generation of high voltage is stopped at point in time t13. Detection of the commencement of discharge can be performed in the feeder circuit Ux on the basis of the lamp current detection signal Si or the lamp voltage detection signal Sv. Now, if the cessation of discharge, or burnout, is detected after that, the startup control signal Sz can be activated to start production of the intermittent drive control signal.

Incidentally, in this specification, the secondary winding Sh is described as producing a quasi-continuous alternating current high voltage; this "quasi-continuousness" appears continuous when the voltage waveform of the secondary winding Sh is macroscopically observed on an oscilloscope, as shown in FIG. 9, with the time scale from 1 to 100 ms that is typical for the starter operation interval.

Figure 10:
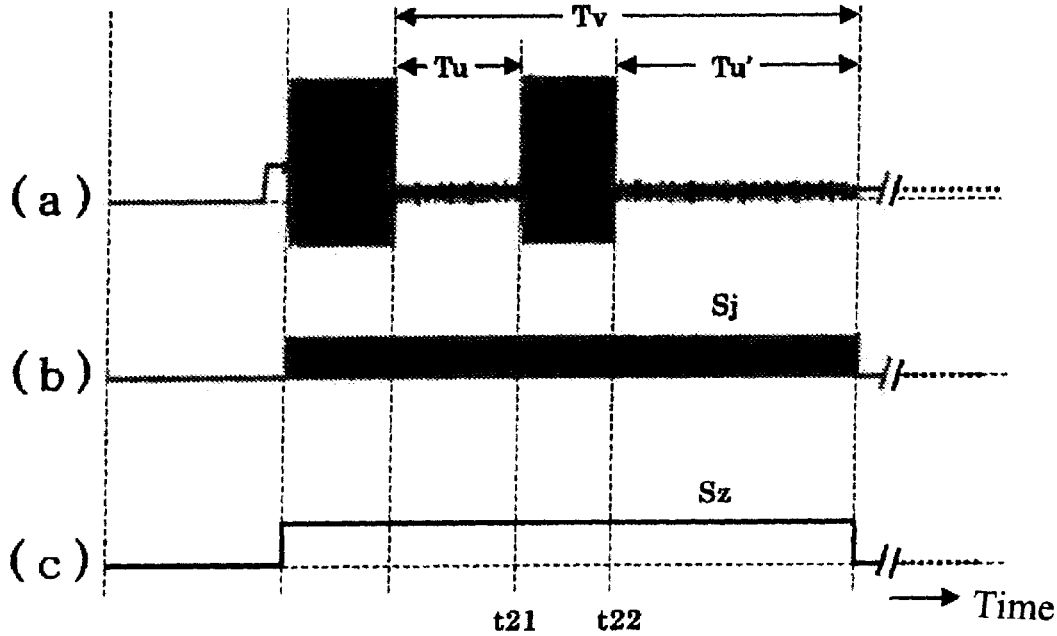
FIG. 10 is a simplified timing chart of an embodiment of the discharge lamp ignition device of this invention.

FIG. 10 is an example of a timing chart showing conceptually the operation of the discharge lamp ignition device of this invention. As in FIG. 9, plot (a) represents the waveform of the voltage impressed on the electrodes E1, E2 of the discharge lamp Ld, plot (b) represents the state of the intermittent drive control signal Sj, and plot (c) represents the state of the startup control signal Sz, but this figure depicts the situation of the discharge lamp Ld burning out after the main discharge has begun.

If there is no concern that the main discharge of the lamp will burn out after it has begun, the operation of the intermittent voltage impression means Uj can be stopped. In circumstances or periods Tv where there is a possibility of discharge burnout, however, it is preferable to continue operation of the intermittent voltage impression means Uj even after the main discharge of the lamp has begun.

In this case, since as stated previously, the inductance of the discharge lamp Ld is low during the lamp's main discharge, either as a glow discharge or an arc discharge, the transformer Th does not produce a high voltage. However, when discharge burnout occurs, the inductance of the lamp returns to a high state, and so an alternating current high voltage immediately arises in the transformer Th and startup is re-executed. The figure shows that a glow discharge or arc discharge is present in the period Tu, but burnout occurs at the point in time t21, and then the discharge is automatically restarted at the point in time t22; a glow discharge or arc discharge continues through the period Tu' and thereafter.

Another embodiment of this invention is explained with reference to FIG. 11, which shows, in simplified form, another embodiment of the discharge lamp ignition device of this invention. The explanation to this point has been primarily of embodiments constituted with the capacitor Ch and the secondary winding Sh connected in parallel, but the discharge lamp ignition device of this figure is constituted with the capacitor Ch and the secondary winding Sh connected in series.

With the discharge lamp ignition device of this embodiment, as with those previously described, a state in which the voltage output from the feeder circuit Ux is overlaid by an oscillating high voltage output from the secondary winding Sh is realized on a quasi-continuous basis, and energy is effectively injected into the lamp in a state of glow discharge; the excellent effect of the invention is fully exhibited. Now, with the discharge lamp ignition device of this drawing too, it is possible to feed power to the starter circuit even when the feeder circuit Ux output voltage is suppressed.

Another embodiment of this invention is explained with reference to FIG. 12, which shows another embodiment of the discharge lamp ignition device of this invention in simplified form. In the transformer Th of the discharge lamp ignition device of this figure, the primary winding Ph and the secondary winding Sh share a common terminal, and so this embodiment has such advantages as that it is possible to reduce the insulation characteristics between the primary and secondary windings of the transformer Th, and that it is possible to simplify the structure of, for example, the winding barrier; these are advantages in terms of reduction of size and cost. Further, although a starter circuit Ut' of the series triggering type is shown, it is also possible to use one of the external triggering type, as shown in FIG. 11.

Figure 14:
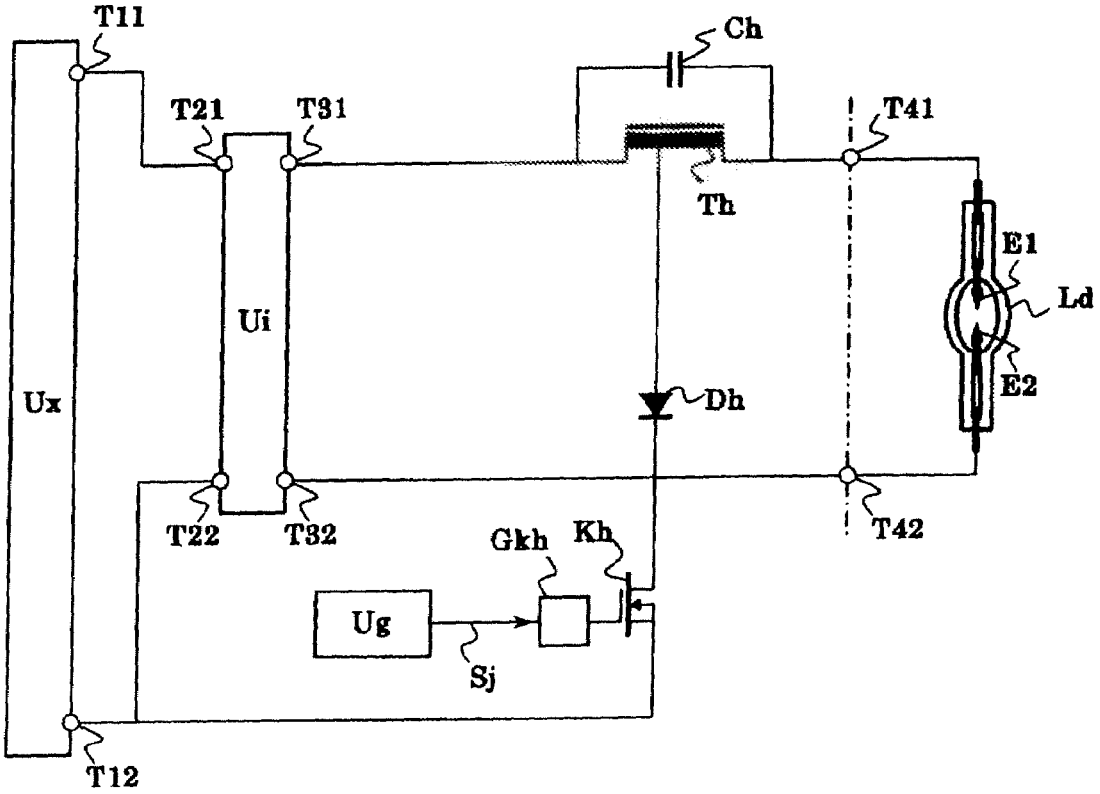
FIG. 14 is a diagram showing the constitution of an embodiment of the discharge lamp ignition device of this invention in simplified form.

Another embodiment of this invention is explained with reference to FIG. 14, which shows in simplified form on embodiment of the discharge lamp ignition device of this invention. In the transformer Th of the discharge lamp ignition device of this drawing, the primary winding Ph and the secondary winding Sh are the same, constituted with a center tap. By means of this constitution, the structure of the winding barrier is simplified by eliminating the insulation characteristics required between the primary and secondary windings, and it is possible to reduce the number of turns in the combined primary and secondary windings, and so there are the advantages of reducing the size and cost of the transformer Th. To this point, explanations of the capacitor Ch have been primarily of embodiments with a parallel connection with the secondary winding Sh, but in the discharge lamp ignition device of this drawing, the capacitor Ch is connected in parallel with the transformer Th as a whole.

Now, the operation at startup of the inverter Ui of the discharge lamp ignition device of this invention should be understood. With a power supply of the alternating current drive type, there is no need for the inverter to have the same operating frequency at startup as during steady burning. It is possible, for example, to stop the inverter and operate on direct current during startup, or conversely to have a higher inverter frequency during startup than during steady burning. How that is done can be decided in response to various objectives, such as improving the service life of the lamp or improving the speed with which the lamp reaches full luminosity, from the perspective of promoting or restraining discharge heating of the discharge lamp, or from the perspective of balance. In the implementation of this invention too, operation of the inverter can be set as desired on the basis of the situation. However, in the event that as in FIGS. 11 & 12, the power supply to the starter circuit Ut, Ut' is performed at a stage subsequent to the inverter Ui and the inverter is stopped during startup, naturally the ON/OFF status of the inverter switching elements Q1, Q2, Q3, Q4 will have to be matched to the power supply conditions in the starter circuit Ut, Ut'.

Figure 15:
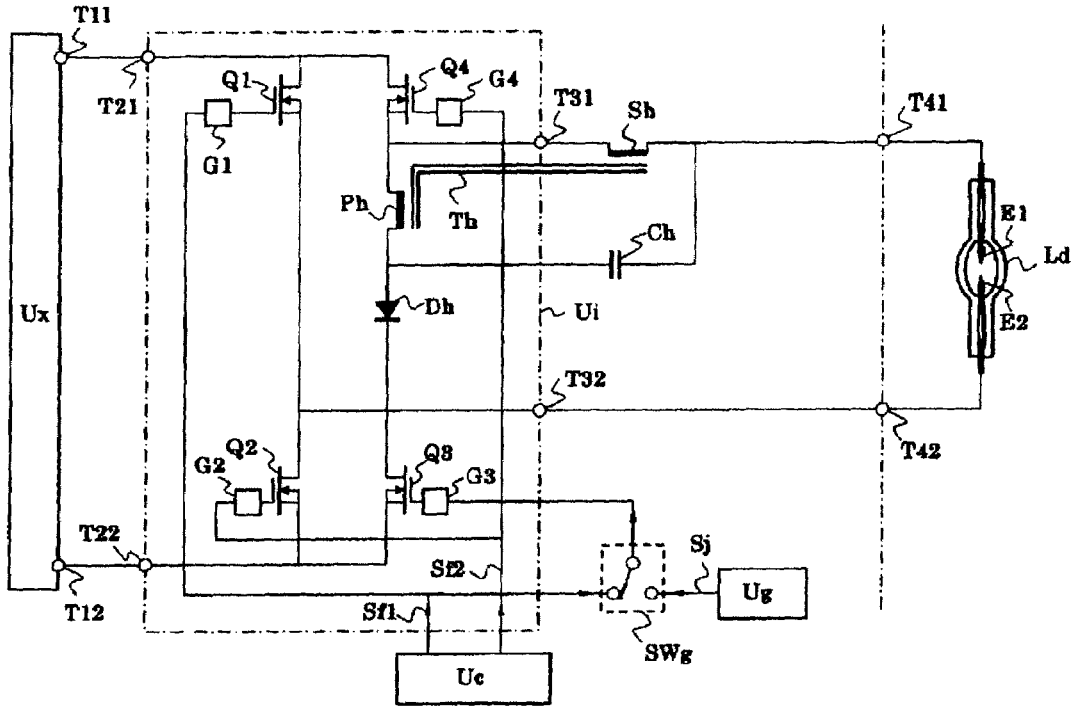
FIG. 15 is a diagram showing the constitution of an embodiment of the discharge lamp ignition device of this invention in simplified form.

Another embodiment of this invention is explained with reference to FIG. 15, which shows, in simplified form, another embodiment of the discharge lamp ignition device of this invention. The transformer Th of the discharge lamp ignition device of this drawing is constituted such that a switching element Q3 in the inverter Ui is combined with the voltage impression drive switching element Kh, with the advantage of further reduction in size. At startup, with the switching elements Q1, Q3 in the OFF state and the switching elements Q2, Q4 in the ON state, the selection switch SWg selects the intermittent drive control circuit Ug side, and the switching element Q3 is cycled ON and OFF in accordance with the intermittent drive control circuit Ug. When the switching element Q3 is ON, voltage is impressed on the primary winding Ph, and so a voltage is generated in the secondary winding Sh and, as a result, a voltage higher than the no-load discharge voltage is impressed on the two terminals of the discharge lamp Ld, enabling the lamp to receive sufficient energy for transition to arc discharge. When lamp startup is completed, switching the selection switch SWg to the inverter control signal Sf1 side enables normal alternating current drive operation controlled by the inverter control circuit Uc.

Figure 11:
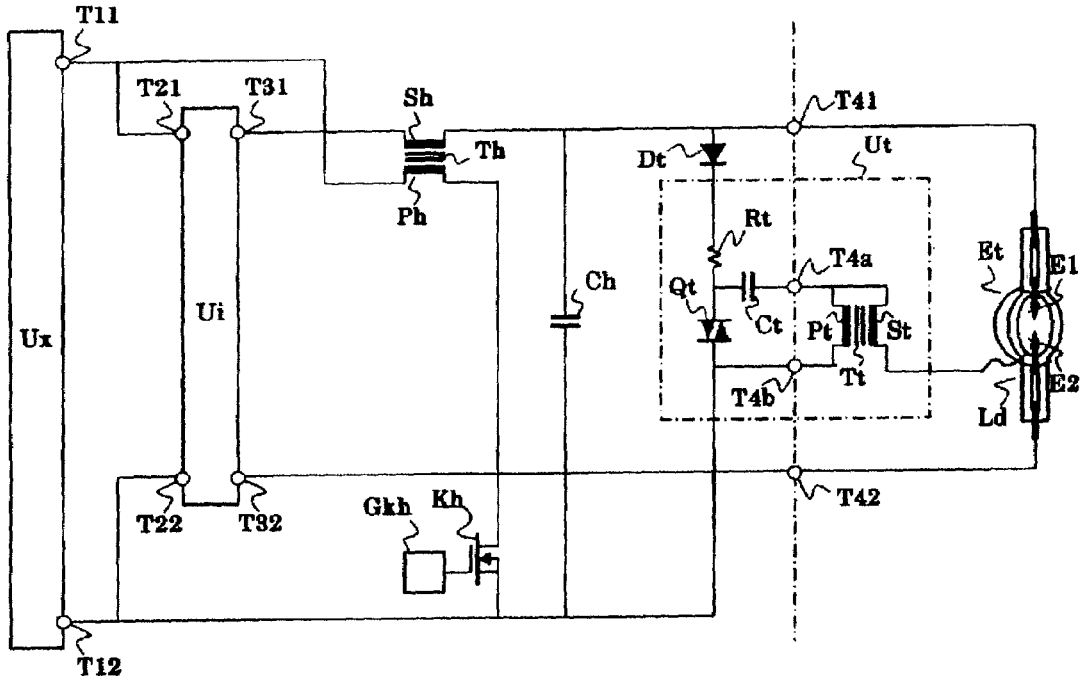
FIG. 11 is a diagram showing the constitution of an embodiment of the discharge lamp ignition device of this invention in simplified form.
Figure 12:
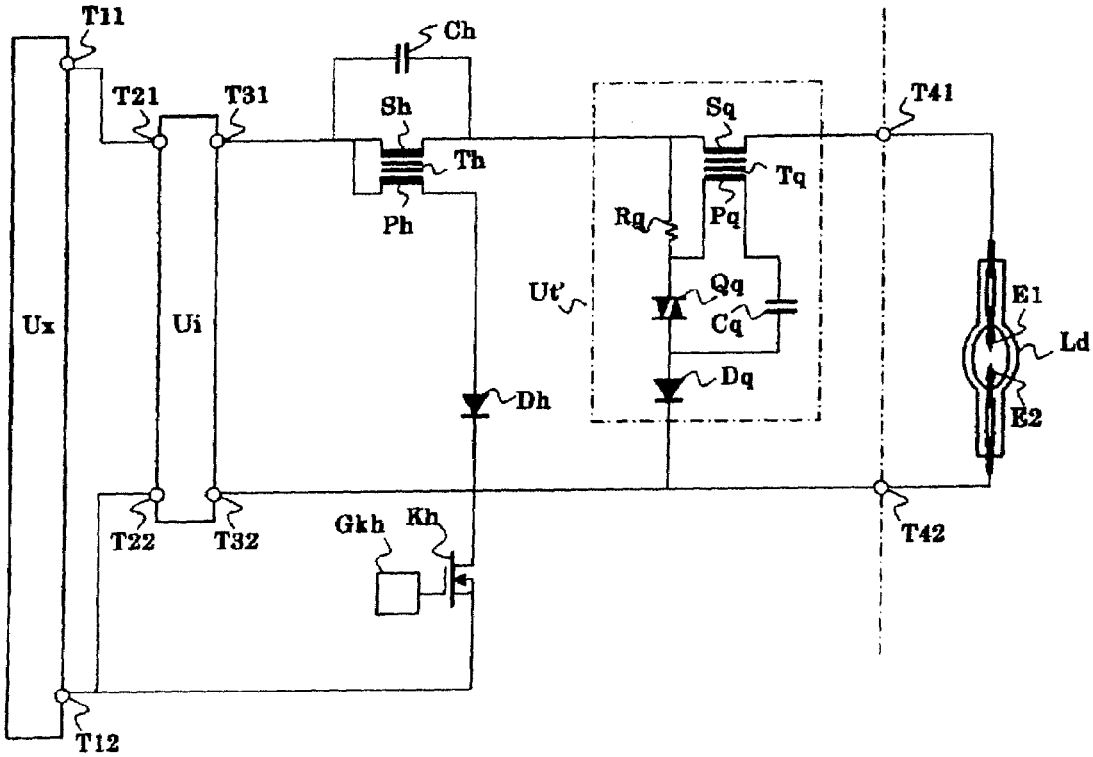
FIG. 12 is a diagram showing the constitution of an embodiment of the discharge lamp ignition device of this invention in simplified form.
Figure 13:
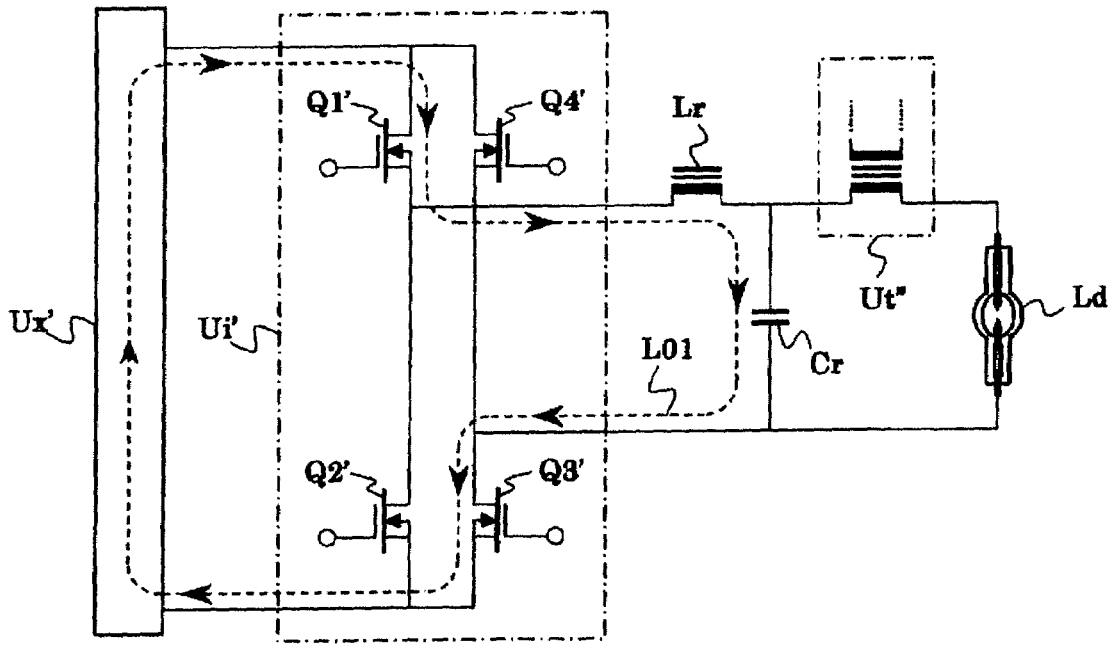
FIG. 13 is a diagram showing the constitution of an embodiment of a conventional discharge lamp ignition device in simplified form.

In the embodiments described so far, there have been cases as in FIGS. 7, 11, & 12 in which the discharge lamp Ld is started up using starter circuits Ut, Ut' of the external or series triggering type in addition to having the discharge lamp Ld started up by a high voltage generated in the secondary winding Sh of the transformer Th. It is also possible, however, to have no starter circuit at all. Accordingly, whether or not a starter circuit Ut, Ut' of the external or series triggering type is also used is not a substantial point in this invention; whether or not one is used can be decided on the basis of the ease of starting the discharge lamp Ld and the level of the voltage generated in the secondary winding Sh. For example, when some sort of auxiliary startup means, such as a proximity conductor or auxiliary startup lamp is placed in the discharge lamp Ld, the possibility of omitting use of a starter circuit Ut, Ut' will be high.

There can easily be scattering of the levels of voltage produced in secondary windings Sh for impression on the discharge lamp Ld; this largely originates in inconsistencies in the manufacture of transformers Th. In order to suppress scattering in the level of voltage produced in the secondary winding Sh, it is desirable to detect a signal corresponding to the voltage and provide feedback to the operation of the intermittent voltage impression means Uj. For example, if the discharge lamp ignition device of this invention produces high voltage in the secondary winding Sh by means of fly-back action of the transformer Th and the intermittent voltage impression means Uj, it will be possible to increase or decrease the voltage produced in the secondary winding Sh by increasing or decreasing the ON time of the voltage impression drive switch Kh on the basis of the detection signal mentioned above.

Further, if the discharge lamp ignition device of this invention produces high voltage in the secondary winding Sh by means of forward action of the transformer Th and the intermittent voltage impression means Uj, it will be possible to increase or decrease the voltage produced in the secondary winding Sh by increasing or decreasing the voltage of the voltage impression drive power supply Mh on the basis of the detection signal mentioned above. Now, this signal corresponding to the voltage produced in the secondary winding Sh can be handled by detecting the peak value of the voltage between terminals when the voltage impression drive switch Kh is in the OFF state such as the voltage between the source and drain if the switching element is an FET, or by detecting the peak value of current flowing when the voltage impression drive switch Kh is in the ON state, or by detecting the actual voltage produced in the secondary winding Sh.

The transformer Th should be understood as well. The explanation, to this point, has featured a single secondary winding Sh connected to either of the electrodes E1, E2 for the main discharge of the discharge lamp Ld, but it is also possible to have two secondary windings Sh and to connect each to one of the electrodes E1, E2 so as to impress voltages of opposite polarity on them. In that case, if a capacitor Ch is connected to a secondary winding Sh, it can be connected to either of the two secondary windings Sh, or to both.

In description of the circuit constitution in this specification, only the minimum necessary for explanation of the actions, functions, and operations of the discharge lamp ignition device of this invention has been described. Accordingly, explanations of the circuit constitution and the details of operation, such as the polarity of signals and the selection or addition of specific circuit elements has been omitted, and original ideas, such as changes based on economic factors or the convenience of obtaining elements may, of course, be carried out at the time of actual design of the equipment.

In particular, it will of course be possible to add to sections of the circuit constitution described in the embodiment examples, as required, mechanisms to protect circuit elements, such as FETs or other switching elements, from harmful factors, such as excessive voltage, current, or heat, and mechanisms to reduce the occurrence of radiation noise or conduction noise that accompanies the operation of circuit elements of the power supply or to keep noise that is generated from escaping to the outside, such as snubber circuits, varistors, clamp diodes, current-limiting circuits including the pulse-by-pulse type, common mode or normal mode noise filter choke coils, noise filter capacitors, and so on. The constitution of the discharge lamp ignition device of this invention is not limited to the circuit types described in this specification.

EXPLANATION OF SYMBOLS

Ce Capacitor
Ch Capacitor
Cq Capacitor
Cr Resonant capacitor
Ct Capacitor
Cx Smoothing capacitor
Cmg Comparator
Cmv Comparator
Dh Diode
Dq Diode
Dt Diode
Dx Flywheel diode
E1 Electrode
E2 Electrode
Et Auxiliary electrode
Fx Feeder control circuit
G1 Gate drive circuit
G2 Gate drive circuit
G3 Gate drive circuit
G4 Gate drive circuit
Gkh Gate drive circuit
Gx Gate drive circuit
Ix Lamp current detection means
Kh Lamp voltage impression drive switching element
L01 Route
Ld Discharge lamp
Lr Resonant coil
Lx Choke coil
Mh Voltage impression drive power supply
Mx DC power supply
Ph Primary winding
Pq Primary winding
Pt Primary winding
Q1 Switching element
Q1' Switching element
Q2 Switching element
Q2' Switching element
Q3 Switching element
Q3' Switching element
Q4 Switching element
Q4' Switching element
Qe Voltage-sensitive switching element
Qez Switching element
Qq Switching element
Qt Switching element
Qx Switching element
Re Resistance
Rez Resistance
Rq Resistance
Rt Resistance
Sf1 Inverter control signal
Sf2 Inverter control signal
Sg Gate drive signal
Sh Secondary winding
Si Lamp current detection signal
Sj Intermittent drive control signal
Sq Secondary winding
St Secondary winding
Sv Lamp voltage detection signal
Sz Startup control signal
T11 Node
T12 Node
T21 Node
T22 Node
T31 Node
T32 Node
T41 Node
T42 Node
T4*a* Node
T4*b* Node
Th Transformer
Ti Cycle
Tj Period
Tq Starter transformer
Tt Starter transformer
Tu Cycle
Tu Cycle
Tv' Cycle
Tw Cycle
Uc Inverter control circuit
Ug Intermittent drive control circuit
Ui Inverter
Ui' Inverter
Uj Intermittent voltage impression means
Ut Starter circuit
Ut' Starter circuit
Ut" Starter circuit
Ux Feeder circuit
Ux' Feeder circuit
Vme Voltage
Vnl Voltage
t11 Point in time
t12 Point in time
t13 Point in time
t21 Point in time
t22 Point in time
SWg Selection switch

What is claimed is:

1. A discharge lamp ignition device for lighting a discharge lamp having a pair of facing electrodes as main electrodes, comprising:

a feeder circuit for feeding power to the discharge lamp, an inverter located at a stage following the feeder circuit that inverts the polarity of a voltage impressed on the discharge lamp, a transformer with a primary winding and a secondary winding, a capacitor connected to the transformer, and an intermittent voltage impression means for drive impression of voltage on the primary winding of the transformer;

wherein the secondary winding of the transformer is constituted such that the voltage generated in the secondary winding is impressible overlapping the output voltage of said inverter between the electrodes of the discharge lamp by means of interposing it in a path connecting the output of the inverter and the electrodes for the main discharge of the discharge lamp;

wherein the capacitor has a capacitance with a value such that a free oscillation frequency of the voltage generated in the secondary winding does not exceed 3 MHz;

wherein, during startup of the discharge lamp, the intermittent voltage impression means drives voltage impression at an average frequency of at least 8,000 repetitions per second and the voltage impression drive continues for a period after discharge begins in the discharge lamp.

2. A discharge lamp ignition device as described in claim 1, wherein the total of inductance components along a main discharge current route of the discharge lamp in stages subsequent to the inverter does not exceed 160 μH.

3. A discharge lamp ignition device as described in claim 1, wherein the intermittent voltage impression means comprises a voltage impression drive power supply and a voltage impression drive switching element, and impresses a voltage on the primary winding when the voltage impression drive switching element is in an ON state.

4. A discharge lamp ignition device as described in claim 3, wherein the voltage that is output for the feeder circuit to impress as the no-load discharge voltage is set lower than a glow discharge voltage generated in the discharge lamp.

5. A discharge lamp ignition device as described in claim 1, wherein the voltage that is output for the feeder circuit to impress as the no-load discharge voltage is set lower than a glow discharge voltage generated in the discharge lamp.

* * * * *